US006322405B1

(12) United States Patent
Griffith, Sr. et al.

(10) Patent No.: US 6,322,405 B1
(45) Date of Patent: Nov. 27, 2001

(54) REVERSING CONTROL FOR TROLLING MOTOR PROPULSION SYSTEM

(75) Inventors: Thomas E. Griffith, Sr., Florence, MS (US); Jeffrey T. Hudson, Murfreesboro, TN (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/540,090

(22) Filed: Mar. 31, 2000

(51) Int. Cl.[7] ..... B60L 11/02
(52) U.S. Cl. ..... 440/6; 114/144 B
(58) Field of Search ..... 440/6, 7; 114/144 B, 114/144 R

(56) References Cited

U.S. PATENT DOCUMENTS 3,995,579 * 12/1976 Childre ..... 440/7
4,471,708 * 9/1984 Wilson et al. ..... 114/265
5,401,195 * 3/1995 Yocom ..... 440/6

* cited by examiner

*Primary Examiner*—Ed Swinehart
(74) *Attorney, Agent, or Firm*—Fletcher, Yoder & Van Someren

(57) ABSTRACT

An operator input device for a propulsion unit on a watercraft. The propulsion unit is of the type having an electric motor and a prop drivingly coupled to the electric motor. The operator input device includes a control circuit coupled to the propulsion unit and a switch coupled to the control circuit. The switch is adapted to momentarily alter a predefined rotational state of the prop when activated by the operator. Prior to activation of the switch the propulsion system operates having a predefined rotational state of the prop in a first rotational direction and at a first pre-selected speed. When the switch is activated, the motor and prop may be altered regarding either rotational speed, direction or both.

30 Claims, 3 Drawing Sheets

REVERSING CONTROL FOR TROLLING MOTOR PROPULSION SYSTEM

BACKGROUND OF THE INVENTION

1. Field of the Invention

The present invention relates generally to electric propulsion systems for recreational watercraft. More specifically the present invention relates to propulsion systems which employ operator input devices such as foot pedals, and more particularly the utilization of an operator input device to momentarily reverse the rotational direction of the propulsion system.

2. Description of the Related Art

Recreational watercraft are extremely popular for a variety of uses. Many watercraft rely on an outboard or inboard motor as a primary propulsion device. This type of motor typically includes an internal combustion engine drivingly coupled to prop, which supplies thrust to the watercraft. In watercraft outfitted for fishing purposes, a secondary propulsion system is often employed. These secondary propulsion systems are commonly known as trolling motors or electric outboards. Trolling motors are typically light weight electric motors drivingly coupled to a prop for propelling a fishing boat. Because of the relatively small size and quiet operation of such motors, they are often used to propel the boat into remote and shallow regions of a body of water.

Secondary propulsion systems, or trolling motors, are often connected to an operator input device such as a foot pedal. The operator will utilize the foot pedal to control the amount of thrust and direction of thrust of the trolling motor. In many instances, the trolling motor may be operated and controlled without diverting the user from fishing activities. While these trolling motor systems, including the operator input devices, have well served their intended use, but they are not without the possibility for improvement. For example, the typical trolling motor, because it is intended to venture into otherwise inaccessible areas, may often become bogged down or entangled with weeds about the prop. Such an event becomes a time consuming and annoying delay to the operator. The delay often entails shutting off the trolling motor and removing the weeds from the prop by hand. Attempts to remedy this problem have been met with varying degrees of success. Still, weed entangled props prove to be a recurring problem for numerous fisherman and watercraft operators.

Another area where improvement may be seen is in the thrust and directional control of the trolling motors. For example, current trolling motors coupled to a foot pedal or other input device are relatively simplistic in their functionality. Typically a foot pedal will allow the operator to turn left, turn right, engage forward thrust, and set the speed of the motor (i.e., vary the amount of thrust). To propel the watercraft in reverse the operator normally must rotate the trolling motor 180° from the current orientation by employing a turn left or turn right command. This poses a problem when an obstacle is noted too late to execute the reversal, or when the prop has already become entangled in weeds or submerged plant growth. The operator would obviously prefer enhanced maneuverability in situations as these, but instead is limited by the functionality of the input device.

There is, therefore, a need in the art for a watercraft secondary propulsion system, or trolling motor system which improves functionality and maneuverability of the watercraft. There is a need to provide such a system that will also minimize, if not eliminate, the operator's efforts in disentangling the prop when encumbered with weeds or debris. Such a system should preferably be adaptable to existing trolling units as well as applicable to new designs.

SUMMARY OF THE INVENTION

The invention provides a technique for controlling an electrical propulsion system designed to respond to these needs. The propulsion system includes an electric motor and a prop drivingly coupled to the electric motor. An operator input device includes a control circuit coupled to the propulsion unit. A switch is coupled to the control circuit and is adapted to momentarily alter a predefined rotational state of the prop when activated by the operator. Prior to activation of the switch the propulsion system may operate in a predefined rotational state of the prop in a first rotational direction (i.e. clockwise or counterclockwise), and at a first pre-selected speed. The first rotational state may be defined to provide a forward or reverse thrust at a desired speed. When the switch is activated, the operation of the motor and prop is altered, by reversal of the rotational direction and, where desired, the speed of rotation. For example, the switch may be a momentary reverse switch causing the motor and prop to reverse directions at a maximum speed of rotation.

In accordance with another aspect of the technique, an operator input device is provided for a propulsion unit on a watercraft. The propulsion unit is of the type having an electric motor and a prop drivingly coupled to the electric motor. The operator input device includes a control circuit coupled to the propulsion unit. A switch is coupled to the control circuit and is adapted to alter a predefined rotational direction of the prop upon activation by the operator. Prior to activation of the switch, the propulsion system operates having a predefined rotational state of the prop in a first rotational direction, (i.e. clockwise or counterclockwise) and at a first pre-selected speed. Again, the first rotational state may be defined to provide a forward or reverse thrust at a desired speed. When the switch is activated, direction of rotation of the motor and prop is reversed. The motor and prop may then continue in the reverse direction until a subsequent command is received.

In accordance with another aspect of the technique, a method of controlling a propulsion unit on a watercraft is provided. The propulsion unit is of the type having an electric motor drivingly coupled to a prop. The method includes the acts of defining a first rotational state of the prop. A signal is then provided to the electric motor. The signal causes a momentary reversal of the rotational state of the prop. The signal may, alternatively result in sustained reversal of the prop rotation.

The technique may be applied to a wide variety of system designs. In particular, the technique is well suited both to conventional trolling motor and electric outboard configurations, and to alternative designs, such as inboard and twin propulsion unit systems.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

Figure 1:
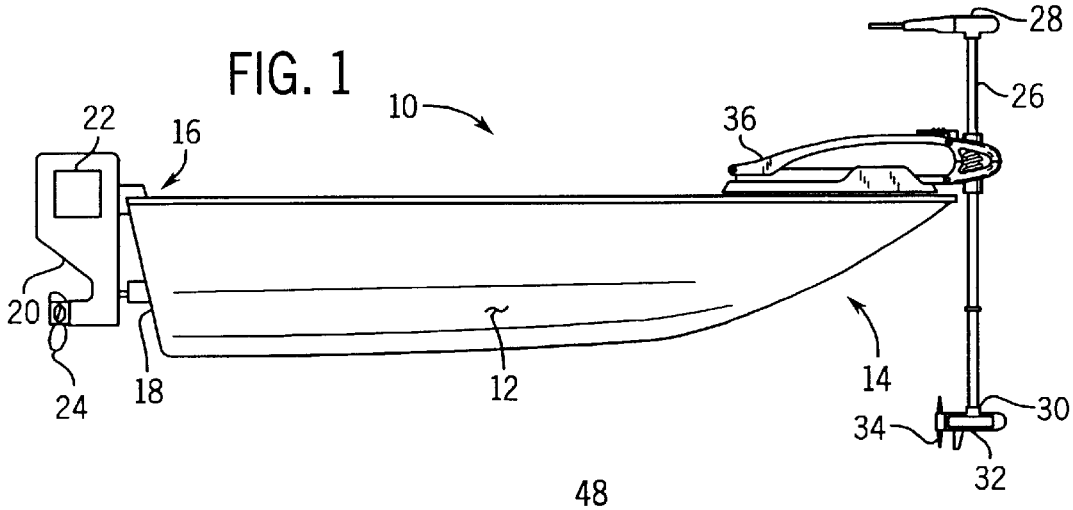
FIG. 1 is an elevational side view of a watercraft employing a propulsion system in accordance with certain aspects of the present technique.

Turning now to the drawings and referring first to FIG. 1, a watercraft 10 is shown. The watercraft 10 includes a hull 12 which has a bow section 14 and a stem section 16. The stem section includes a transom 18. Mounted to the transom 18 is a primary propulsion unit 20, shown here as an outboard motor. At the bow 14 of the watercraft 10 is a secondary propulsion system or trolling motor 26. The secondary propulsion system 26 includes a control head 28 and a propulsion unit 30. The control head 28 houses electrical components and circuitry, and may include a directional control mechanism for changing the direction or angular orientation of the propulsion unit 30 with respect to the watercraft 10.

The propulsion unit includes an electric motor 32 and a prop 34 drivingly coupled to the electric motor 32. The electric motor 32 may be any of a number of configurations such as, for example, a brush type DC motor, a brushless DC motor, or a switched reluctance type motor. The electrical components and circuitry housed in the control head 28 are coupled to the electric motor 32 to provide control signals and electrical energy to the electric motor 32. In the embodiment of FIG. 1, the secondary propulsion unit 26 is shown to be mounted on the deck or gunwale of the watercraft 10. The components for supporting the propulsion unit and rotating its orientation may be substantially identical to those found in conventional trolling motors or electric outboards.

It is noted that the secondary propulsion unit 26, as shown in FIG. 1, places the electric motor 32 in a location which requires it to be submersed during operation. As will be appreciated by those skilled in the art, such deployment requires that the motor be placed in a proper housing which is adequately sealed to prevent fluid from entering into the electric motor 32. Such designs are understood by those of ordinary skill in the art and are not discussed in detail herein. However, it is contemplated that the electric motor could be located in such a way that submersion of the electric motor would not be required. For example, the motor 32 could be placed in the control head 28 instead of being adjacent to the prop 34. In such an alternative embodiment, the electric motor 32 would be drivingly coupled to the prop by way of shafts and gears, flexible shafts, and so forth, for proper transmission of mechanical power to the prop 34.

Figure 2:
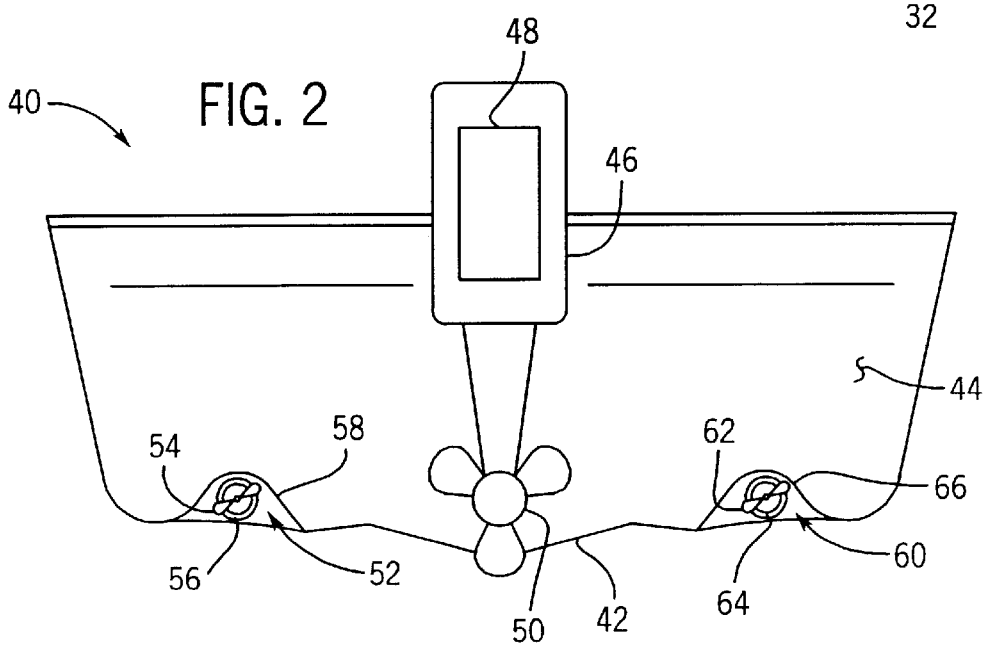
FIG. 2 is an elevational rear view of another watercraft employing a differently configured propulsion system, also in accordance with aspects of the technique.

Turning now to FIG. 2, an alternative embodiment is shown from the stern view. The watercraft 40 of this embodiment includes a hull 42 having a transom 44 to which a primary propulsion system 46 is mounted. The primary propulsion system 46 includes an internal combustion engine 48 which is drivingly coupled to a prop 50. The primary propulsion system 46, shown here as an outboard motor, produces thrust to displace the watercraft 40 through a body of water. A secondary propulsion system is also provided in this embodiment. The secondary propulsion system includes dual or twin propulsion units 52 and 60. Each propulsion unit 52 and 60 includes a prop 54 and 62 and an electric motor 56 and 64, respectively. Each propulsion unit 52 and 60 is mounted within a small recess, 58 and 66 respectively, on the underside of the hull.

In the embodiment shown in FIG. 2 the props 54 and 62 are mounted in a fixed orientation or position. Thus, while the props 54 and 62 may rotate about their respective axis to produce the required thrust, the thrust direction is generally fixed with respect to the hull 42. With both propulsion units 52 and 60 directionally fixed, the watercraft 40 is steered by varying the relative speed and/or direction of each prop 54 and 62. For example, for "straight ahead" navigation, both propulsion units would rotate at the same or nearly the same speed and in the same direction. To turn the watercraft to the left, or port side, the port side propulsion unit 52 would either rotate slower than the starboard side propulsion unit 60, or it could rotate in reverse direction while the starboard side propulsion unit 60 provides a forward thrust. Thus, the propulsion units 52 and 60 do not require independent directional mechanisms for proper navigation of the watercraft 40, although such modifications could be made, such as to orient the thrust of each unit in a desired direction.

Figure 3:
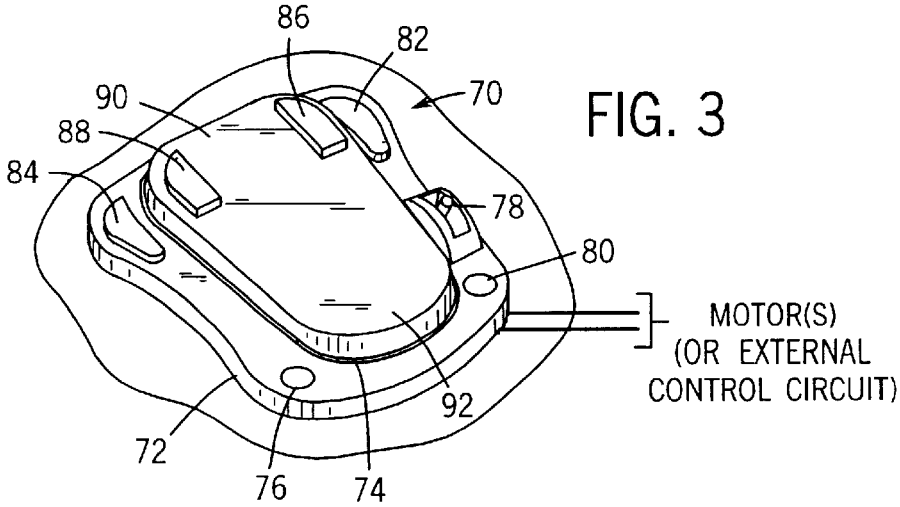
FIG. 3 is a perspective view of a control unit, in the form of a foot pedal control, for inputting operator commands used to navigate the watercraft by powering the propulsion units illustrated in the foregoing figures.

FIG. 3 illustrates an exemplary input device or operator control 70 which may be utilized with either of the embodiments discussed in FIGS. 1 and 2. The operator control 70 is formed as a base 72 on which a foot control 74 is positioned. While the operator inputs may be made through an operator's console, the operator control 70 of FIG. 3 provides for hands-free operation, similar to that available in conventional trolling motor and electric outboard systems. However, the operator control 70 of FIG. 3 includes additional features not found in conventional devices.

In the embodiment illustrated in FIG. 3, the operator control 70 includes a series of switches and inputs for regulating operation of the propulsion system 26 of FIG. 1 or the dual propulsion units 52 and 60 of FIG. 2. By way of example, an on/off switch 76 is provided for enabling the system. A variable speed set or control input 78 is provided for regulating the relative thrust level or velocity of the propulsion system as described more fully below. A trim set switch 80 allows for regulation of nominal offsets between the speeds of dual propulsion units, where provided. Continuous forward and continuous reverse switches 82 and 84 are provided for selecting fixed and continuous forward and reverse operation. Momentary forward and momentary reverse switches 86 and 88 allow the operator to rapidly and temporarily reverse the direction of rotation of the propulsion unit or units as discussed in more detail below. Moreover, foot control 74 may be rocked towards a toe region 90 or toward a heel region 92 to provide a steering input. In a preferred embodiment, the foot control 74 is biased toward a centered position with respect to the steering inputs such that the operator must forcibly depress the foot control towards the toe region or the heel region to obtain the desired left or right steering input. Depressing the foot control 74 towards toe region 90 produces a "steer right" command, while depressing the heel region 92 produces a "steer left" command.

Figure 4:
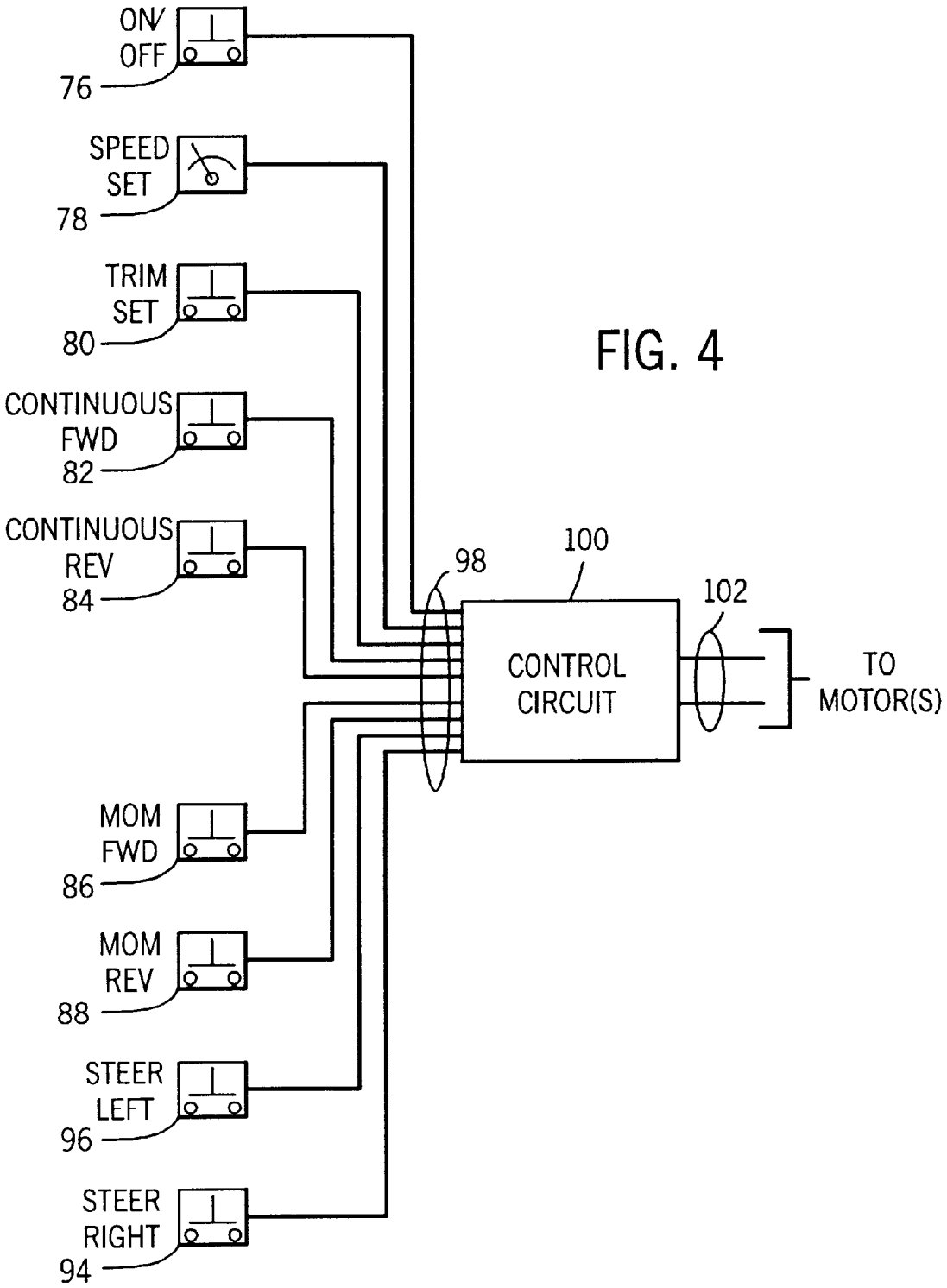
FIG. 4 is a diagrammatical representation of certain of the control input devices associated with the control unit of FIG. 3 in connection with a control circuit for regulating speed and direction of the propulsion units.

FIG. 4 illustrates diagrammatically the arrangement of switches or similar imput devices within operator control 70, and the manner in which they are coupled to a control circuit for regulation of the speeds of motors, 32 or 56 and 64, of the propulsion units. In particular, the on/off switch 76 may be selected (e.g., closed) to provide an on or off command to enable or energize the system. Speed setting 78, which may be a momentary contact switch or a potentiometer input, provides a variable input signal for the speed control within a predetermined speed control range. A momentary contact switch 80 provides for setting a trim adjustment or calibration level in a dual propulsion unit system. The continuous forward and continuous reverse switches 82 and 84 provide signals which place the drive in continuous forward and continuous reverse modes wherein the propulsion units are driven to provide the desired speed set on the speed setting input 78. Momentary forward and momentary reverse switches 86 and 88 are momentary contact switches which cause reversal of the propulsion units from their current rotational direction so long as the switch is depressed. Finally, steer right and steer left switches 94 and 96, provided beneath the toe and heel regions 90 and 92 of the operator control are momentary contact switches which provide input signals to alter the relative rotational speeds or settings of the propulsion units, such as depending upon the duration of time they are depressed or closed.

The control inputs illustrated diagrammatically in FIG. 4, are coupled to a control circuit 100 via communications lines 98. The communications lines 98 transmit signals generated by manipulations or settings of the control inputs to the control circuit. In a presently preferred embodiment, control circuit 100 includes a microprocessor controller, associated volatile and non-volatile memory, and signal generation circuitry for outputting drive signals for motors 32 (FIG. 1), or 56 and 64 (FIG. 2). Moreover, while illustrated separately in FIG. 4, control circuit 100 may be physically positioned within the operator control package. Appropriate programming code within control circuit 100 translates the control inputs to determine the appropriate output drive signals. Upon receiving speed set commands, forward or reverse continuous drive commands, momentary forward or momentary reverse commands, steer left or steer right commands, control circuit 100 determines a level of output signal (e.g., counts from a preset available speed range) to produce the desired navigation thrust as commanded by the operator. Drive signals for the motors are then conveyed via a network bus 102, such as a control area network (CAN), for driving the motor or motors as the case may be. By way of example, functional components for use in control circuit 100 may include a standard microprocessor, and motor drive circuitry available from Semifusion Corporation of Morgan Hill, Calif. A CAN bus interface for use in control circuit 100 may be obtained commercially from Microchip Technology, Inc. of Chandler, Ariz.

It should be noted that, while in the foregoing arrangement, control inputs are received through the operator control only, various automated features may also be incorporated in the system. For example, where electronic compasses, global positioning system receivers, depth finders, fish finders, and similar detection or input devices are available, the system may be adapted to produce navigational commands and drive signals to regulate the relative speeds of the propulsion units to maintain navigation through desired way points, within desired depths, in preset directions, and so forth.

Figure 5:
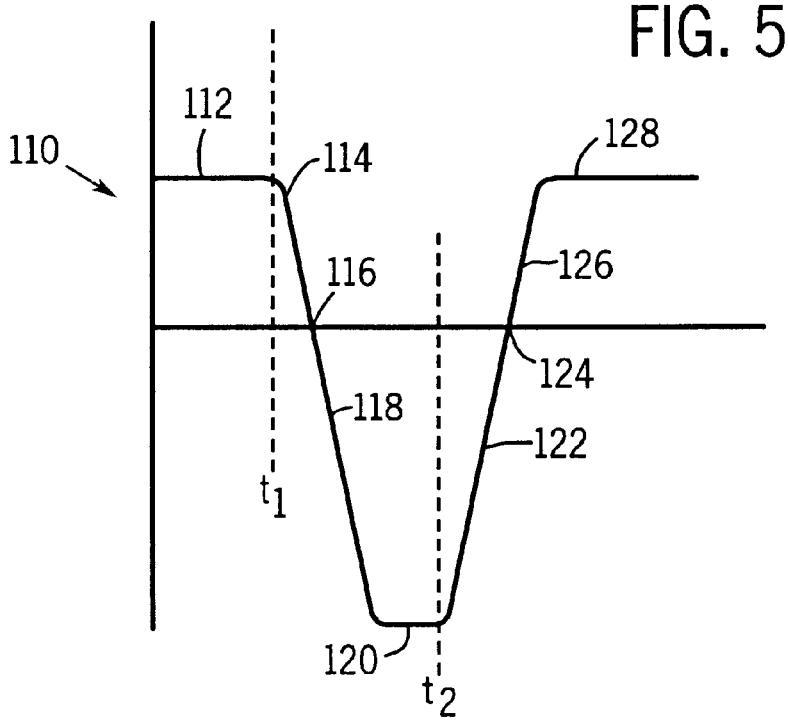
FIG. 5 is a graphical representation of the drive state of a propulsion unit of the operated according to an exemplary embodiment of the present technique.

FIG. 5 is a graphical representation 110 of the drive state for a propulsion system of the types illustrated in the foregoing figures when a momentary reverse switch 88 (FIGS. 3 and 4) is activated. It should be noted that operation is similar, but in inverse directions, when a separate momentary forward switch 86 is present and is activated when the propulsion system is driven in reverse. In describing the drive state 110 reference will be made to the embodiment of FIG. 1, although the same principle of operation may be implemented with the embodiment of FIG. 2, as discussed below.

A first rotational state 112 is defined wherein the electric motor 32 is rotating the prop 34 in a first defined direction at a defined speed. For example, the first rotational state 112 may be a clockwise direction, which provides forward thrust at a speed which is at, in the example, approximately half the to speed of the motor 32. At time $t_1$, the operator activates a momentary reverse switch 88. Control circuit 100, in response to the command, rapidly ramps down drive signals applied to the motor, causing the motor immediately to decrease its speed, as indicated by trace 114, until the rotational speed has a magnitude of zero, as indicated at reference numeral 116. When the rotational speed has reached zero at point 116, control circuit 100 applies drive signals to rotate the motor in the opposite direction (counterclockwise in the example) and the signal rapidly in the reverse direction. The motor 32 thus increases speed in the opposite direction as indicated at reference numeral 118 (represented in this graph as a negative or reverse speed) until a maximum reverse speed is achieved by the motor 32 and prop 34, as indicated at numeral 120.

At time $t_2$ the operator releases the momentary reverse switch 88 and control circuit 100 ramps the motor drive signals back toward a zero speed level. The prop begins to decrease its reverse speed as indicated at reference numeral 122 until the magnitude of the speed again reaches zero at 124. Thereafter, control circuit 100 applies drive signals to again rotate the motor in the initial direction, ramping the signals back to their initial set level. The motor 32 and prop 34 thus again change direction (back to clockwise) and proceed to increase speed as indicated at reference numeral 126 until the desired rotational state is achieved at 128. It is noted that the final rotational state is the same as the original rotational state 112 with regard to speed and direction of rotation.

In utilizing the momentary reverse switch 88, the operator gains added control and functionality. For example, when the watercraft 10 is being propelled into a remote area the prop 34 may become entangled with weeds or debris. Such entanglement may cause the prop to slow down or even stop, creating an overload condition on the motor, and requiring clearing by the operator. However, at first indication of such entanglement, the operator may employ the technique described above to immediately and momentarily reverse the rotation of the prop 34. By doing so, the weeds and debris are spun off the prop 34, typically clearing the prop without the need to retract it for manual clearing.

The above discussion applies equally when initial rotational state of the motor 32 and prop 34 is in a reverse direction. In such a case, the momentary forward switch 86 would be activated to effect a change in the rotational state of the motor and prop. A curve for this situation would look similar to that shown in FIG. 5 but would be horizontally inverted.

It should also be noted that the rotational state of the prop 34 and motor 32 may be altered by changing the rotational speed, while maintaining the rotational direction of the propulsion unit. For example, if the motor 32 and prop 34 are rotating such that a forward thrust is being provided, the operator may activate the momentary forward switch 86 causing the prop and motor to immediately rotate at the maximum speed in the same rotational direction. Upon release of the momentary forward switch 86 to motor 32 and prop 34 would return to the originally defined rotational state. This may be beneficial to the operator in maneuvering the watercraft when an extra burst of speed or thrust is desired. The operator may thereby gain a burst in speed without the need to manually reset the speed of the propulsion unit multiple times.

The technique described above is equally applicable to the embodiment described in FIG. 2. In applying the technique to the embodiment of FIG. 2, the momentary reverse switch 88 may cause both motors 56 and 64 to alter their initial rotational directions similar that described above. It is noted that in the embodiment of FIG. 2, the technique just described could present differences by virtue of the enhanced functionality of the dual motor embodiment. In particular, because each of the motors 56 and 64 can operate at different speeds and in different directions of rotation, the control circuit may be programmed to handle such scenarios. For example, the first motor 56 may rotate in a clockwise direction and the second motor 64 in a counterclockwise direction, causing the watercraft to turn. If the momentary reverse switch 86 is activated during this state, the motors 56 and 64 may each reverse their then-current rotational state. However, it may not be desirable to cause each motor 56 and 64 to reach a maximum speed in their respective reverse directions. Rather it may be desirable to set a maximum allowable speed which is dependant on the differential speed of the two motors prior to reversal (such as to retrace a recent navigational path). Alternatively, it may be desirable to cause one motor to change speed and direction of rotation at a faster rate than the other, thus creating a desired differential between the two motors. Moreover, alternative relational schemes may be programmed into the control circuit for maintaining a desired speed relationship (e.g., constant difference, linearly or non-linearly increasing or decreasing differences) for the two motors, particularly in turning situations.

Figure 6:
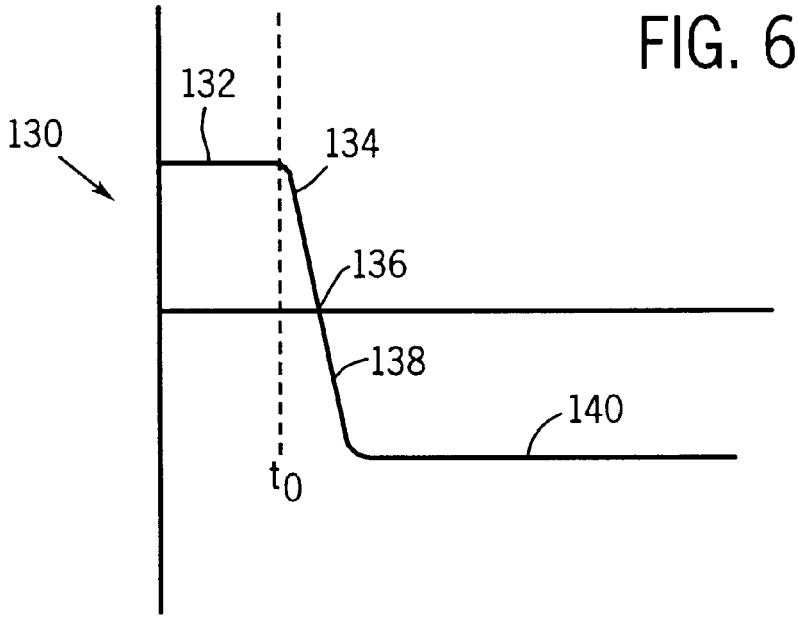
FIG. 6 is a graphical representation of the state of a propulsion unit operated according to another exemplary embodiment.

FIG. 6 is a graphical representation of the drive state for a propulsion system 130 of the type illustrated in the foregoing figures, when a continuous directional switch 82 or 84 (FIGS. 3 and 4) is activated. In describing the drive state 130 reference will be made to the embodiment of FIG. 1, although the same or substantially same mechanisms may be employed with the embodiment of FIG. 2. A first rotational state 132 is defined wherein the electric motor 32 rotates the prop 34 in first defined direction at a defined speed. For example, the first rotational state 132 may be a clockwise direction, providing forward thrust at a speed which is, in the example, approximately half the speed range of the motor 32. At time $t_0$ the operator activates a continuous direction switch for operation in the opposite direction, in this case the continuous reverse switch 84. Control circuit 100 then ramps down the drive signals applied to the motor, and the motor immediately begins to decrease its speed, as indicated by reference numeral 134, until the rotational speed has a magnitude of zero at point 136. When the rotational speed has reached zero at this point 136, the control circuit causes a reversal in the direction of rotation (e.g., to counterclockwise), and the motor is ramped up in speed in the opposite direction as indicated by numeral 138 (represented in this graph as a negative speed). In the illustrated embodiment, when the speed of the motor reaches the preset speed, equal in magnitude to the initial speed in the first direction, the control circuit maintains this level of the control signals, as indicated at 140.

Thus, for example, as a watercraft 10 navigates in a shallow area and the operator notices an obstruction or other type of object in the projected path, the continuous reverse switch 84 may be activated to immediately propel the watercraft 10 away from the object and avoid possible contact or damage to the watercraft. Of course, the technique works similarly when the initial rotational state provides a reverse propulsion and the continuous forward switch 82 is activated. In such a case the curve in FIG. 6 would be inverted horizontally. When applied to the embodiment of FIG. 2, various programming schemes may be implemented to create a desired differential relationship (e.g., constant, linearly or non-linearly increasing or decreasing difference) between the two motors 56 and 64 of the embodiment during turning situations.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A control device for a propulsion unit on a watercraft having an electric motor and a prop drivingly coupled to the electric motor, the operator input device comprising:

a control circuit coupled to the propulsion unit;

a first switch coupled to the control circuit and remote from the propulsion unit, wherein the first switch is adapted to cause the control circuit momentarily to change a predefined rotational state of the prop;

a second switch adapted to cause the control circuit to change a rotational direction of the prop from a first direction to a second direction opposite the first direction and thereafter to maintain rotation of the prop in the second direction; and a third switch adapted to cause the control circuit to change the rotational direction of the prop from the second direction to the first direction.

2. The control device of claim 1, wherein the first rotational direction of the prop provides a forward thrust.

3. The control device of claim 1, wherein the change of rotational direction includes rotating the prop in the second rotational direction at a same pre-selected speed as in the first direction.

4. The control device of claim 1, wherein the first switch is provided on a foot-operated control unit.

5. The control device of claim 1, further comprising at least one additional switch coupled to the control circuit wherein the additional switch is adapted to provide a speed command to the propulsion unit.

6. The control device of claim 5, wherein the control circuit is provided in the control unit.

7. The control device of claim 1, comprising a further switch for setting desired speed of the prop.

8. The control device of claim 1, wherein the activation of the first switch causes the watercraft to change directions without altering an angular orientation of the propulsion unit with respect to the watercraft.

9. The control device of claim 1, wherein the predefined rotational state of the prop is a first rotational direction at a first pre-selected speed.

10. The control device of claim 9, wherein the first rotational direction of the prop provides a forward thrust.

11. The control device of claim 9, wherein the momentary change of state includes rotating the prop in a second rotational direction opposite the first direction.

12. The control device of claim 11, wherein the momentary change of state includes rotating the prop at a second pre-selected speed in the second rotational direction and at a maximum speed.

13. The control device of claim 1, wherein the control circuit is configured to return the prop to the predefined rotational state following deactivation of the switch.

14. A method of controlling a propulsion unit for a watercraft, the propulsion unit having an electric motor drivingly coupled to a prop, the method comprising the acts of:

(a) defining a first rotational state of the prop;

(b) providing a first signal to drive the electrical motor in the first rotational state; and (c) defining a second rotational state of the prop;

(d) providing a second signal to override the first signal, thereby altering the rotational state of the prop; and (e) automatically providing the first signal to drive the electrical motor in the first rotational state when the second signal is removed.

15. The method of claim 14, wherein act (a) includes defining the first rotational state of the prop to have a first rotational direction at a first pre-selected speed such that a forward thrust is provided by the propulsion unit.

16. The method of claim 15, wherein act (d) includes rotating the prop in a second rotational direction opposite the first direction.

17. The method of claim 16, wherein act (d) includes rotating the prop at a second pre-selected speed different from a first pre-selected speed of the rotational state.

18. The method of claim 14, wherein the signal is provided based upon an operator input momentary steering command.

19. The method of claim 18, wherein the momentary steering command originates in a hands-free control unit.

20. A method of controlling a propulsion unit for a watercraft, the propulsion unit having an electric motor drivingly coupled to a prop, the method comprising the acts of:

(a) defining a first and a second rotational direction of the prop;

(b) providing a continuous first signal from an operator control device remote from the propulsion unit to the electrical motor to drive the electric motor in the first rotational direction; and (c) reversing the rotational direction of the prop from the first direction to a the second rotational direction, the second rotational direction being opposite the first rotational direction, in response to a second signal from the operator control device.

21. The method of claim 20, wherein act (a) includes defining a first and second rotational speed of the prop, the second rotational speed being substantially the same as the first speed, but in the second rotational direction following act (c).

22. The method of claim 21, wherein act (c) includes defining a first and a second rotational speed of the prop, the prop being rotated at a second rotational speed different from the first rotational speed following act (c).

23. The method of claim 22, wherein the second rotational speed is substantially equal to a maximum speed in the second direction.

24. The method of claim 20, comprising the further act of returning the prop to the first rotational direction following removal of the signal.

25. A steering system for a watercraft propulsion system having a first and a second propulsion unit, each propulsion unit having an electric motor and a prop drivingly coupled to the electric motor, the control system comprising:

a control circuit coupled to the propulsion unit to control operation of the first and second propulsion units; and a foot operated switch coupled to the control circuit, wherein in a first position of the foot-operated switch the first propulsion unit is driven in a first rotational direction and the second propulsion unit is driven in a second rotational direction, the second rotational direction being opposite the first rotational direction.

26. A control device for a propulsion unit on a watercraft having an electric motor and a prop drivingly coupled to the electric motor, the operator input device comprising:

a first switch coupled to the electric motor, the second switch being operable to direct the prop to rotate continuously in a first rotational state;

a second switch coupled to the electric motor, the third switch being operable to direct the prop to rotate continuously in a second rotational state, the second rotational state being opposite in direction to the first rotational state; and a momentary switch coupled to the control circuit, the momentary switch being operable to temporarily change the rotational state of the prop.

27. The control device as recited in 26, wherein the momentary switch is operable to change prop speed.

28. The control device as recited in 26, wherein the momentary switch is operable to change the direction of rotation of the prop.

29. The control device as recited in 26, wherein the control device is adapted to be operated by foot.

30. The control device as recited in claim 26, further comprising a foot operated steering switch, wherein in a first position of the foot-operated switch a first propulsion unit is driven in a first rotational direction and a second propulsion unit is driven in a second rotational direction, the second rotational direction being opposite the first rotational direction.

* * * * *